US008745901B2

(12) United States Patent
Toraya

(10) Patent No.: US 8,745,901 B2
(45) Date of Patent: Jun. 10, 2014

(54) ARTICLE OF FOOTWEAR WITH TONGUE AND HEEL OPENINGS

(75) Inventor: Erin Elizabeth Toraya, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 91 days.

(21) Appl. No.: 13/247,218

(22) Filed: Sep. 28, 2011

(65) Prior Publication Data

US 2013/0074368 A1 Mar. 28, 2013

(51) Int. Cl.

| | |
|---|---|
| ***A43B 11/00*** | (2006.01) |
| ***A43B 3/00*** | (2006.01) |
| *A43B 23/10* | (2006.01) |
| *A43B 23/00* | (2006.01) |

(52) U.S. Cl.

CPC ..... *A43B 11/00* (2013.01); *A43B 3/0031* (2013.01); *A43B 23/00* (2013.01)

USPC ..... 36/138; 36/136; 36/1; 36/69

(58) Field of Classification Search

CPC ..... A43B 3/166; A43B 3/22; A43B 21/32; A43B 23/16

USPC ..... 36/7.1 R, 138, 54, 3 A, 136, 1

See application file for complete search history.

(56) References Cited

U.S. PATENT DOCUMENTS

| | | | | |
|---|---|---|---|---|
| 129,178 | A * | 7/1872 | Schroeder | 36/51 |
| 384,155 | A * | 6/1888 | Hathorn | 36/1 |
| 1,515,086 | A * | 11/1924 | Baluta | 36/1 |
| 1,560,124 | A * | 11/1925 | Volkey | 36/1 |
| 4,608,769 | A * | 9/1986 | Sturlaugson | 36/68 |
| 4,610,102 | A * | 9/1986 | Hill | 36/136 |
| 5,276,983 | A * | 1/1994 | Hatfield | 36/138 |
| 5,839,210 | A * | 11/1998 | Bernier et al. | 36/50.1 |
| 6,128,837 | A * | 10/2000 | Huang | 36/54 |
| 6,802,139 | B2 * | 10/2004 | Pitts et al. | 36/51 |
| 2001/0011430 | A1 * | 8/2001 | Davis et al. | 36/138 |
| 2005/0183293 | A1 * | 8/2005 | Mick | 36/136 |
| 2006/0037217 | A1 * | 2/2006 | Bernstein | 36/138 |
| 2006/0162187 | A1 * | 7/2006 | Byrnes et al. | 36/54 |
| 2009/0025253 | A1 * | 1/2009 | Harper et al. | 36/7.1 R |
| 2010/0263236 | A1 * | 10/2010 | Carboy et al. | 36/117.1 |

* cited by examiner

*Primary Examiner* — Khoa Huynh
*Assistant Examiner* — Katharine Gracz
(74) *Attorney, Agent, or Firm* — Plumsea Law Group, LLC

(57) ABSTRACT

An article of footwear may have an upper and a sole structure secured to the upper. The upper includes a tongue opening and a heel opening. The tongue opening extends through a tongue of the upper, and the tongue opening is located in a rearward area of the tongue. The heel opening extends into a heel region of the upper. In donning an article of footwear a first finger may extend through an opening in a tongue of the article of footwear. A second finger is located through an opening in a heel region of the article of footwear. The fingers are separated to expand a size of an ankle aperture of the article of footwear, and foot is inserted into the article of footwear through the ankle aperture.

18 Claims, 14 Drawing Sheets

ARTICLE OF FOOTWEAR WITH TONGUE AND HEEL OPENINGS

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

SUMMARY

An article of footwear is disclosed below as having an upper and a sole structure secured to the upper. The upper includes a tongue opening and a heel opening. The tongue opening extends through a tongue of the upper, and the tongue opening is located in a rearward area of the tongue. The heel opening extends into a heel region of the upper.

A method of donning an article of footwear is also disclosed. The method includes extending a first finger through an opening in a tongue of the article of footwear. A second finger is located through an opening in a heel region of the article of footwear. The fingers are separated to expand a size of an ankle aperture of the article of footwear. Additionally, a foot is inserted into the article of footwear through the ankle aperture.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose an article of footwear with a tongue opening and a heel opening that may assist with donning or otherwise locating the footwear on the foot of a wearer. The article of footwear is disclosed as having a general configuration suitable for walking or running. Concepts associated with the footwear, however, may also be applied to a variety of other athletic footwear types, including baseball shoes, basketball shoes, cross-training shoes, cycling shoes, football shoes, tennis shoes, and soccer shoes, for example. The concepts may also be applied to footwear types that are generally considered to be non-athletic, including dress shoes, loafers, and boots. The concepts disclosed herein apply, therefore, to a wide variety of footwear types and are not limited to the various configurations presented herein.

General Footwear Structure

Figure 1:
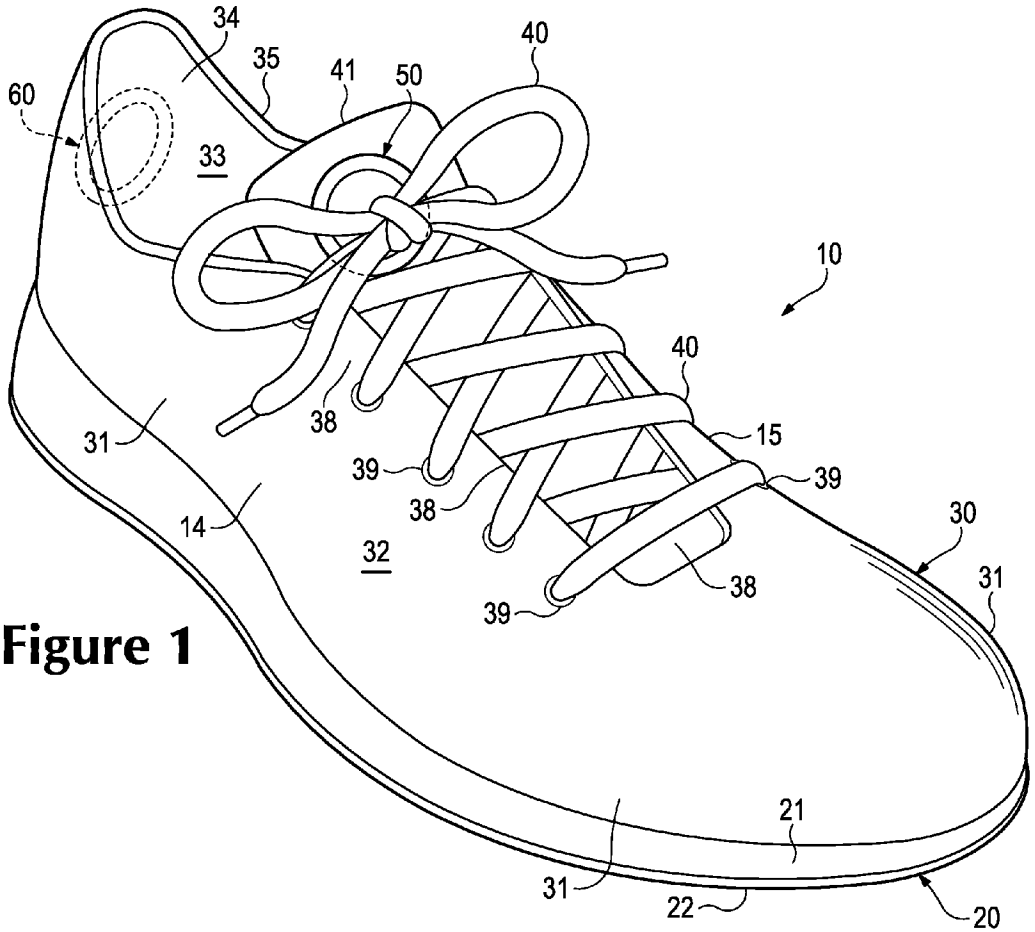
FIG. 1 is perspective view of an article of footwear.
Figure 2:
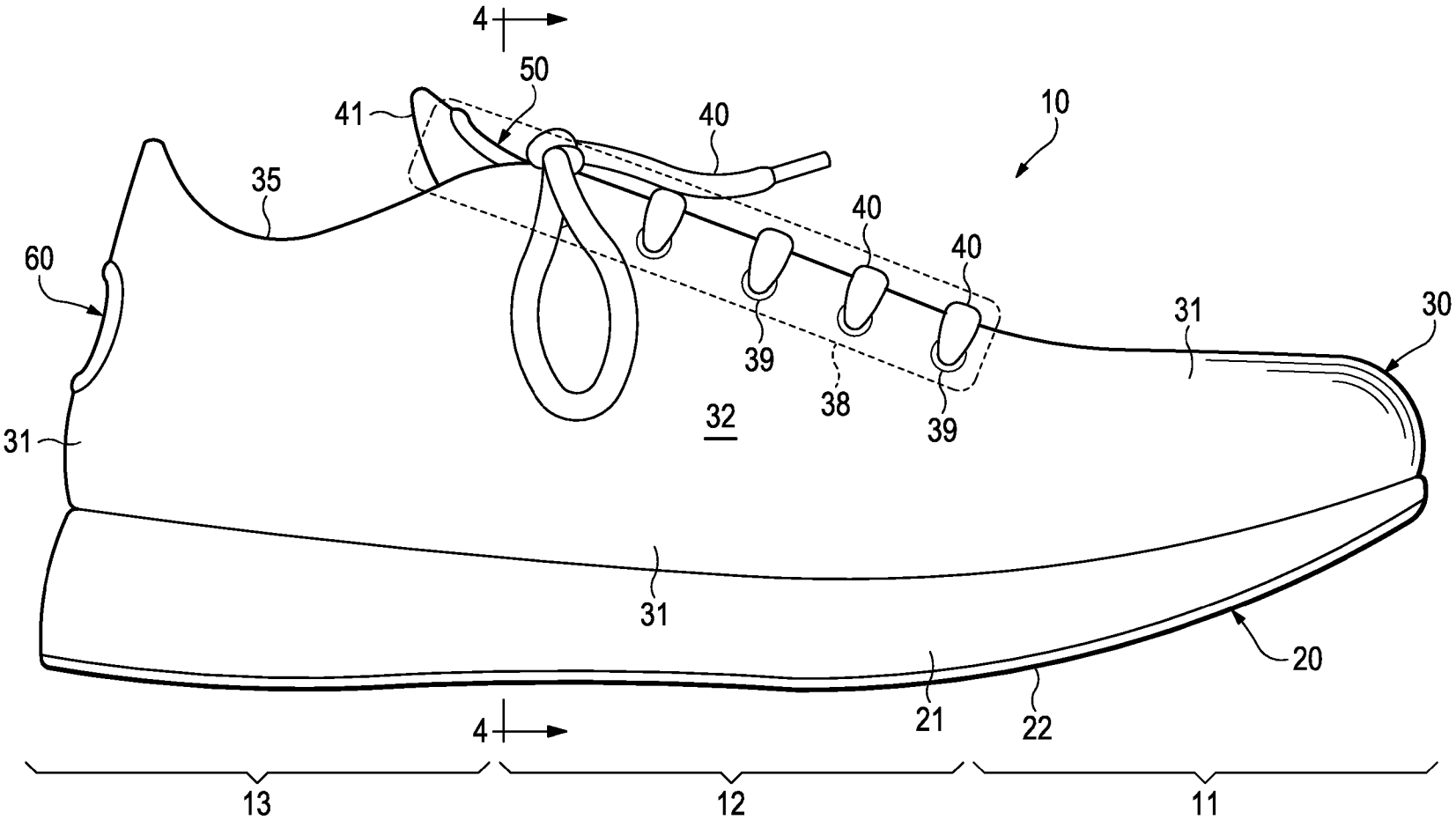
FIG. 2 is a side elevational view of the article of footwear.
Figure 3:
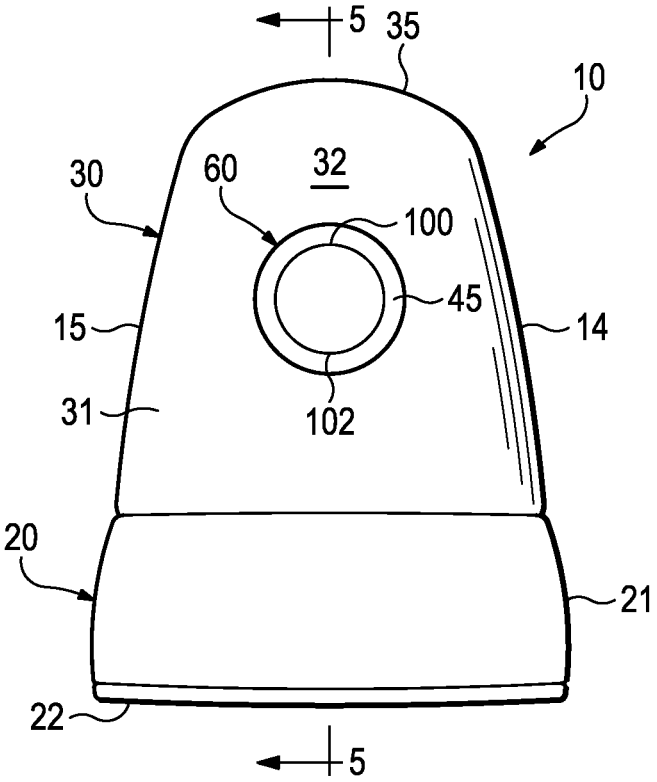
FIG. 3 is a rear elevational view of the article of footwear.

An article of footwear 10 is depicted in FIGS. 1-3 as including a sole structure 20 and an upper 30. Sole structure 20 is secured to a lower area of upper 30 and extends between upper 30 and the ground. Upper 30 provides a comfortable and secure covering for a foot of a wearer. As such, the foot may be located within upper 30, which effectively secures the foot within footwear 10, and sole structure 20 extends under the foot to, for example, attenuate forces, enhance stability, or influence the motions of the foot.

For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Figure 5:
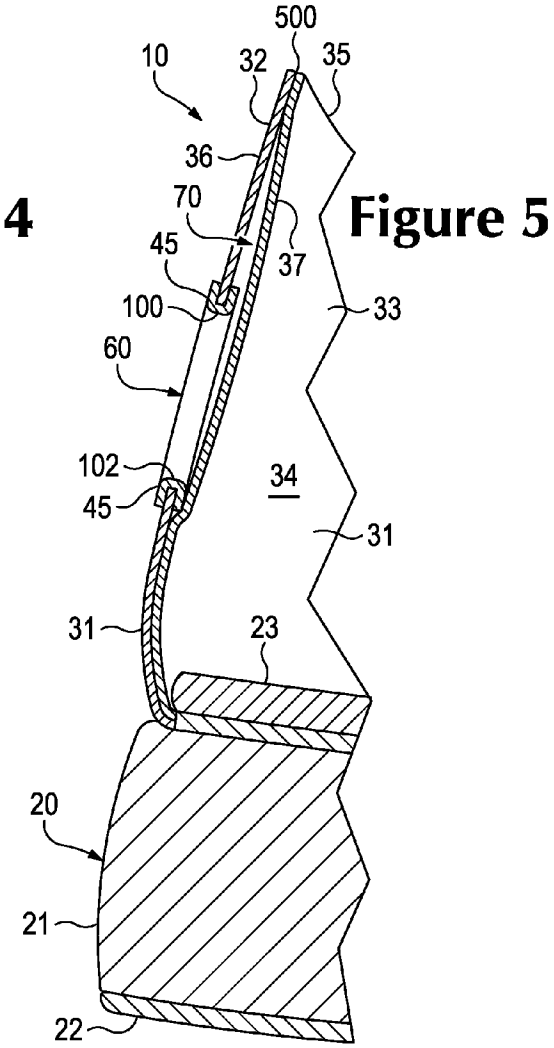
FIG. 5 is a cross-sectional view of the article of footwear, as defined by section line 5 in FIG. 3.
Figure 4:
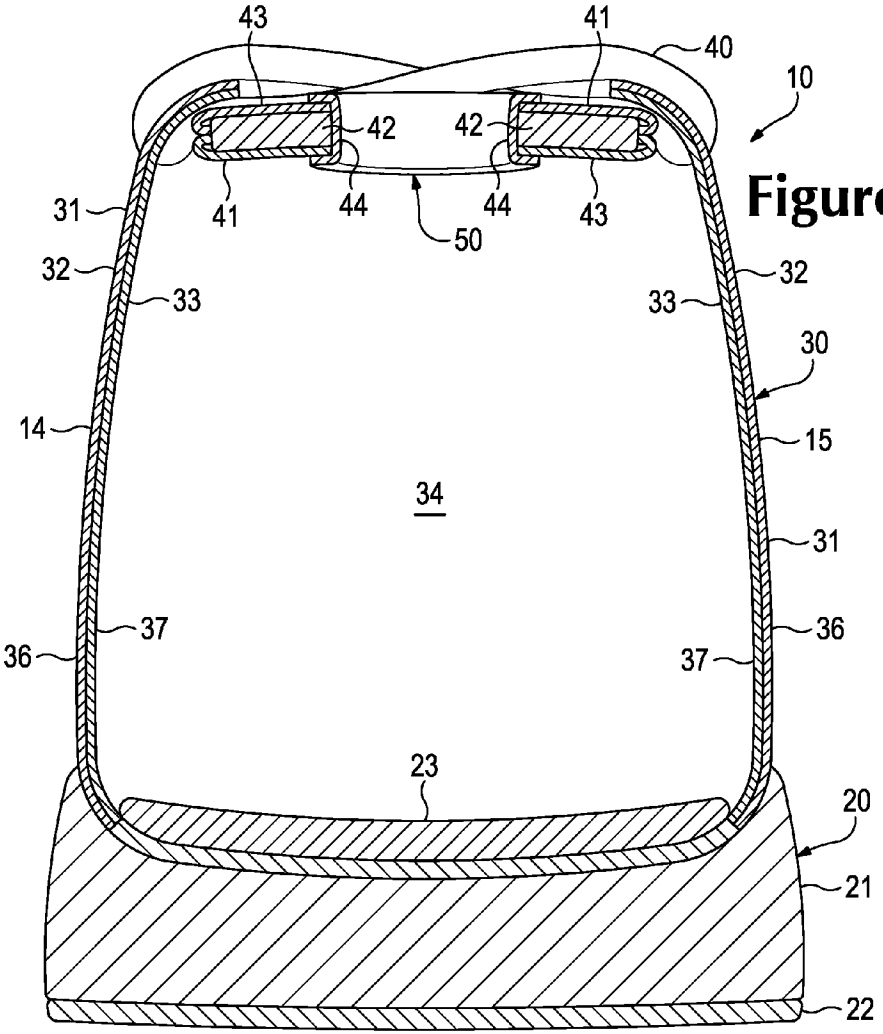
FIG. 4 is a cross-sectional view of the article of footwear, as defined by section line 4 in FIG. 2.

Sole structure 20 includes a midsole 21, an outsole 22, and an sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30, as depicted in FIGS. 4 and 5, and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30, as noted above, is secured to sole structure 20 and provides a comfortable and secure covering for a foot of a wearer. A majority of upper 30 is formed from a covering element 31 having an exterior surface 32 and an opposite interior surface 33. Exterior surface 32 forms a portion of an exterior of footwear 10, and interior surface 33 defines a portion of a void 34 within upper 30 for receiving the foot. As such, void 34 is generally configured to accommodate the foot and may have a general shape of the foot. An upper edge 500 of covering element 31 defines an ankle aperture 35 in at least heel region 13 for providing the foot with access to void 34.

Covering element 31 extends (a) along a portion of void 34 in lateral side 14, (b) along a portion of void 34 in medial side 15, (c) over void 34 in a forefoot region 11, and (d) around void 34 in heel region 13. The various portions of covering element 31 may be formed from one or more of a plurality of material elements (e.g., textiles, polymer sheet layers, polymer foam layers, leather, synthetic leather) that are stitched or bonded together to form the void within footwear 10. Referring to FIGS. 4 and 5, for example, covering element 31 includes a first layer 36 and a second layer 37 that may be formed from any of the materials noted above. Whereas first layer 36 forms a portion of exterior surface 32, second layer 37 is located inward of first layer 36 and forms a portion of interior surface 33. In further configurations, and as described below, covering element 31 may include (a) one or more additional layers, (b) a heel counter that stabilizes a heel of the foot in heel region 13 or (c) a wear-resistant toe guard located in forefoot region 11. Although not depicted, indicia in the form of trademarks, for example, and material and care information may also be secured to or printed on portions of covering element 31 or other elements of upper 30.

A portion of upper 30 defines a throat area 38 that is located in at least midfoot region 12. Throat area 38 extends rearward (i.e., toward ankle aperture 35) from forefoot region 11 or a forward area of midfoot region 12, as generally shown in FIG. 2, and includes a plurality of lace-receiving elements 39 and a lace 40 that is engaged with lace-receiving elements 39. More particularly, lace-receiving elements 39 are depicted as being apertures that extend along opposite sides of throat area 38, and lace 40 extends through and crosses between lace-receiving elements 39 in a generally zigzagging (e.g., W-shaped) pattern. In other configurations, lace 40 may be routed in an alternate manner, or lace 40 may be utilized in conjunction with another lace to form an alternate lacing system. Lace 40 permits the wearer to modify dimensions of upper 30 to accommodate the proportions of the foot. More particularly, lace 40 slides through lace-receiving elements 39 and permits the wearer to (a) tighten upper 30 around the foot and (b) loosen upper 30 to facilitate entry and removal of the foot from void 34 (i.e., through ankle aperture 35). As an alternative to apertures, lace-receiving elements 39 may be loops, eyelets, hooks, or D-rings, for example. Although throat area 38 is depicted as being centered in upper 30, throat area 38 may also be offset or otherwise non-centered.

Additionally, upper 30 includes a tongue 41 that enhances the comfort of footwear 10 and assists with modifying the dimensions of upper 30. Within footwear 10, tongue 41 extends longitudinally through throat area 38 and is positioned below lace-receiving elements 39 and lace 40. As such, tongue 41 forms a portion of void 34 and contacts the foot when footwear 10 is worn. In some configurations, tongue 41 is secured to upper 30 in the forward portion of throat area 38 (i.e., in forefoot region 11). Although tongue 41 may have a variety of configurations, tongue 41 may include an interior element 42 and an exterior sheath 43 extending around interior element 42. As examples, interior element 42 may be formed from a polymer foam material and exterior sheath 43 may be formed from a textile. In further configurations, tongue 41 may be formed from other materials or may have a different structure. For example, tongue 41 may be formed from a knitted element or interior element 42 may be absent. In some configurations tongue 41 may include a loop or other structure that receives lace 40 and assists with maintaining the position of tongue 41.

Opening Configurations

Upper 30 includes a tongue opening 50 and a heel opening 60 that assist with donning or otherwise placing footwear 10 upon the foot. Tongue opening 50 extends through a portion of tongue 41 (e.g., both interior element 42 and exterior sheath 43) and is located in a rearward area of tongue 41 (e.g., adjacent to ankle aperture 35). Tongue opening 50 is also centrally located between sides of tongue 41, thereby being generally centered between sides 14 and 15. In this location, tongue opening 50 may be spaced inward from edges of tongue 41 and located in a portion of tongue 41 that is generally not covered by lace 40.

Although tongue opening 50 may have a variety of shapes, as discussed below, tongue opening 50 is depicted as having a circular shape. As an example, with tongue opening 50 having the circular shape, a suitable dimension extending across tongue opening 50 (e.g., a diameter of tongue opening 50) is 2 centimeters. In other configurations, the dimension extending across tongue opening 50 is often at least 1.5 centimeters, which is sufficient to permit a finger of the wearer to pass into tongue opening 50 when placing footwear 10 upon the foot, although the size of tongue opening 50 may vary considerably to be in a range of 0.5 and 5 centimeters. Moreover, tongue opening 50 may have a generally larger size when utilized in configurations of footwear 10 for adults, and tongue opening 50 may have a generally smaller size when utilized in configurations of footwear 10 for children.

To reinforce and finish tongue opening 50, a flashing element 44 is secured to opposite sides of exterior sheath 43, passes through tongue 41 and tongue opening 50, and extends around tongue opening 50. In addition to reinforcing and finishing tongue opening 50, flashing element 44 may provide a comfortable material for contacting the finger of the wearer when located within tongue opening 50.

Heel opening 60 extends into an area of heel region 13. More particularly, heel opening 60 extends through exterior surface 32 and toward interior surface 33. Heel opening 60 may have a topmost point 100 that is the closest to point to upper edge 500 and a bottommost point 102 that is the closest point to sole structure 20. Although heel opening 60 may form an aperture that extends through covering element 31, thereby exposing a portion of void 34, heel opening 60 is depicted as extending through first layer 36 and not extending through second layer 37. Heel opening 60 is located in a rearwardmost area of upper 30. Moreover, heel opening 60 is spaced downward from an upper edge of covering element 31, which forms ankle aperture 35. Although the position of heel opening 60 may vary significantly, heel opening 60 is depicted in FIGS. 2 and 3 as being positioned at a midpoint of a distance between the upper edge of covering element 31 and an area where upper 30 is secured to sole structure 20. That is, heel opening 60 is located at a midpoint of a height of covering element 31 in heel region 13. In some configurations, a center of heel opening 60 may correspond with the midpoint, but in other configurations the center of heel opening 60 may be offset from the midpoint, but a portion of heel opening 60 may still cover or correspond with the midpoint. In other configurations, some of which are discussed below, heel opening 60 may be (a) 2.5 centimeters from the upper edge of covering element 31 or (b) approximately one-fourth or one-third of the distance between the upper edge of covering element 31 and an area where upper 30 is secured to sole structure 20.

As with tongue opening 50, a suitable dimension extending across heel opening 60 (e.g., a diameter of tongue opening 50) is 2.0 centimeters, but is often at least 1.5 centimeters or in a range of 0.5 and 5 centimeters. Moreover, heel opening 60 may have a generally larger size when utilized in configurations of footwear 10 for adults, and heel opening 60 may have a generally smaller size when utilized in configurations of footwear 10 for children.

To reinforce and finish heel opening 60, another flashing element 45 is secured to first layer 36 and extends into heel opening 60. In addition to reinforcing and finishing heel opening 60, flashing element 45 may provide a comfortable material for contacting the finger of the wearer when located within heel opening 60.

Heel opening 60 provides access to a pocket 70 that is formed within upper 30 and adjacent to heel opening 60. Whereas a finger of the wearer may pass through tongue 41 at tongue opening 50, heel opening 60 only passes partially through upper 30. As such, pocket 70 forms an area for receiving the finger of the wearer that passes through heel opening 60. In general, pocket 70 is located between exterior surface 32 and interior surface 33 of covering element 31. More particularly, pocket 70 is depicted in FIG. 5 as area where first layer 36 and second layer 37 are unsecured to each other. As such, pocket 70 may be an area where materials or material layers forming covering element 31 are unsecured to each other. As shown in FIG. 5, first layer 36 is secured to second layer 37 along the area between sole structure 20 and bottommost point 102 of heel opening 60. Pocket 70 is also located in an area between heel opening 60 and the upper edge of covering element 31, which forms ankle aperture 35.

Donning Footwear

Figure 6A:
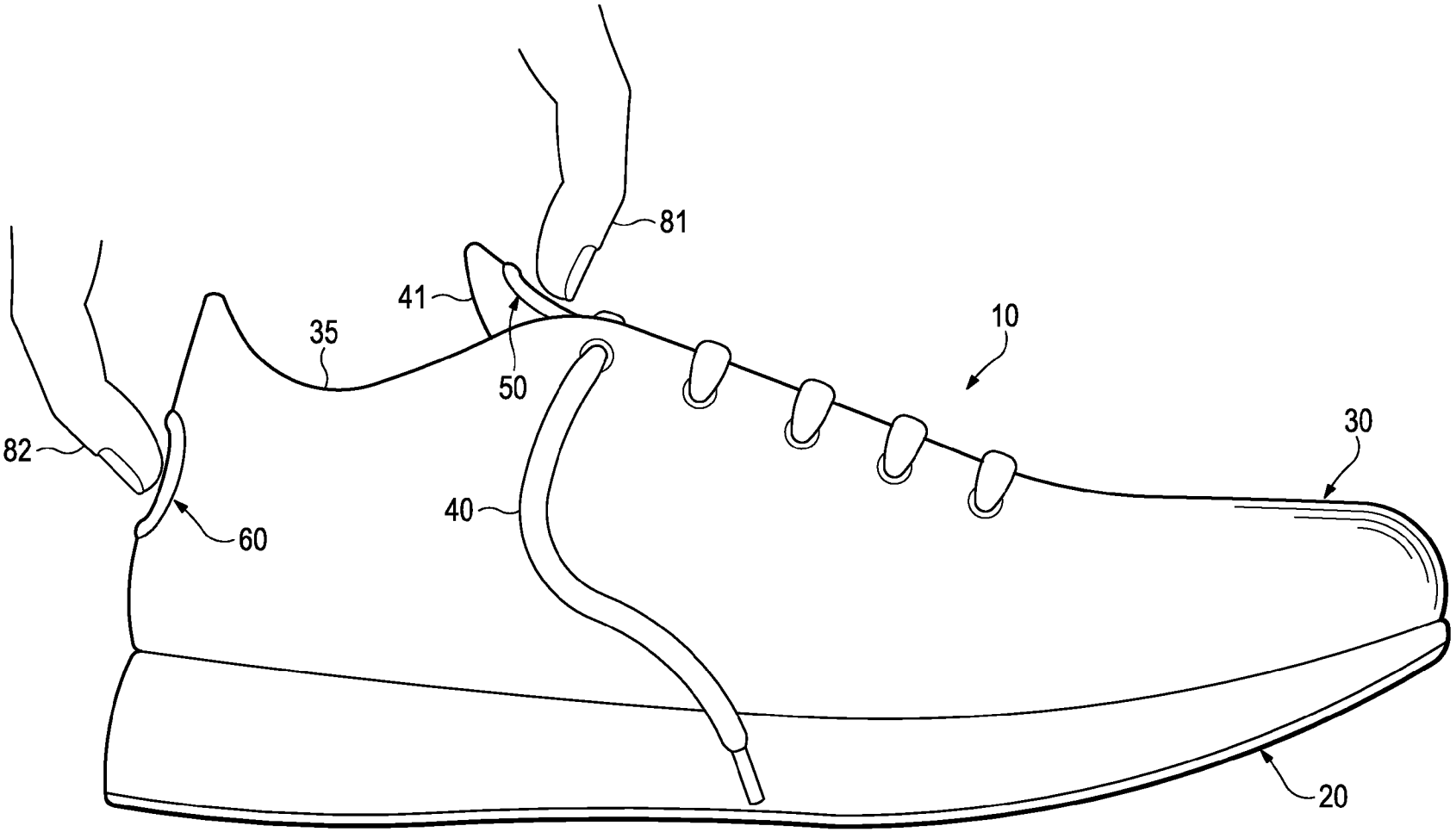
FIGS. 6A-6C are schematic side elevational views depicting a process of donning the article of footwear.

As noted above, tongue opening 50 and heel opening 60 assist with donning or otherwise placing footwear 10 upon the foot. In order to demonstrate the general manner in which tongue opening 50 and heel opening 60 may be utilized, a method of donning footwear 10 will now be discussed. Referring to FIG. 6A, a first finger 81 extends through tongue opening 50 and a second finger 82 is located through heel opening 60. Additionally, second finger 82 extends between two material layers (i.e., first layer 36 and second layer 37) forming heel region 13 of covering element 31, thereby being positioned within pocket 70. Given that pocket 70 may be located between heel opening 60 and the upper edge of covering element 31, second finger 81 also extends toward ankle aperture 35. For purposes of clarity, fingers 81 and 82 are generally fingers from different hands of the wearer.

Figure 6B:
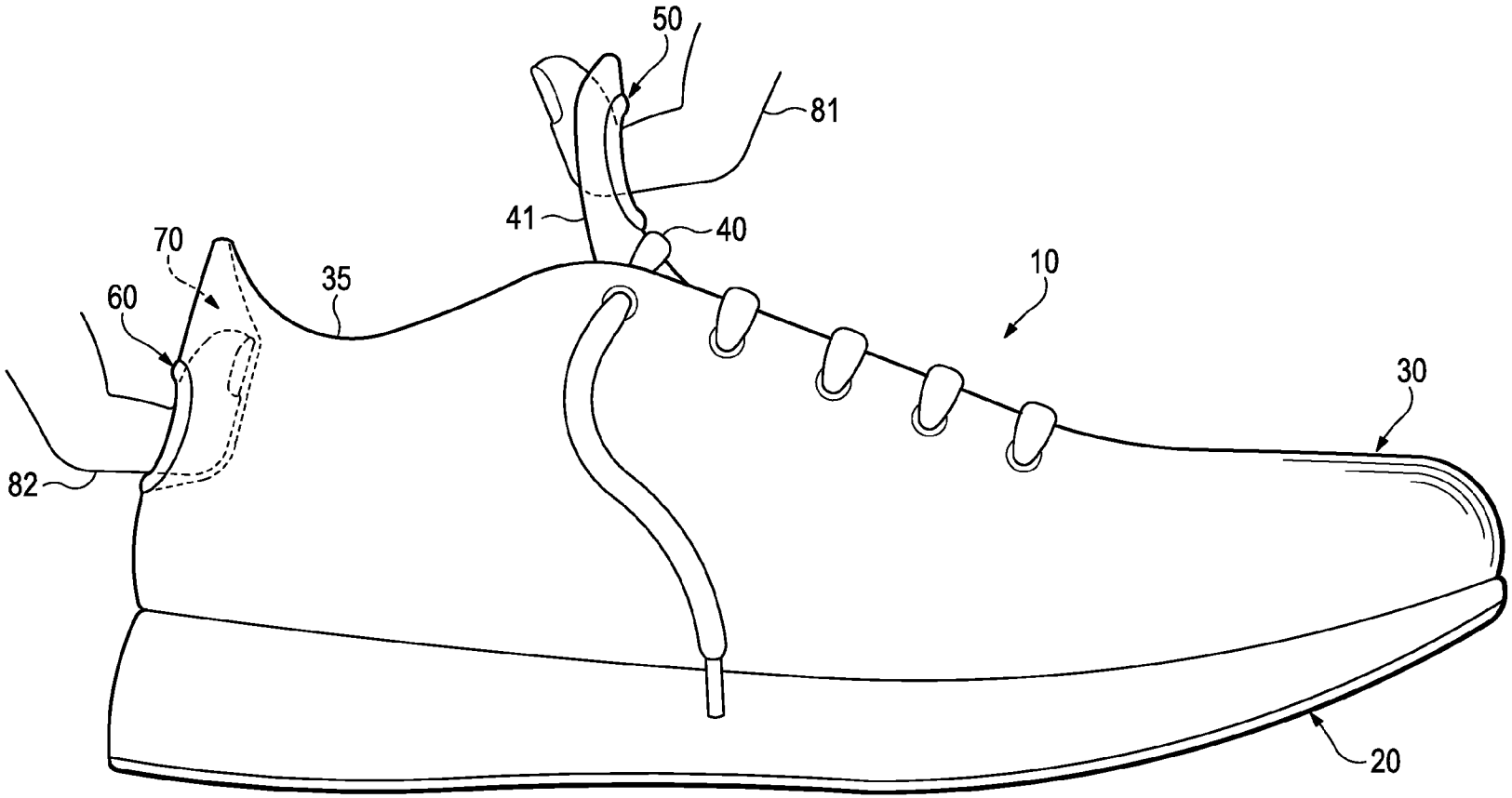
Figure 6C:
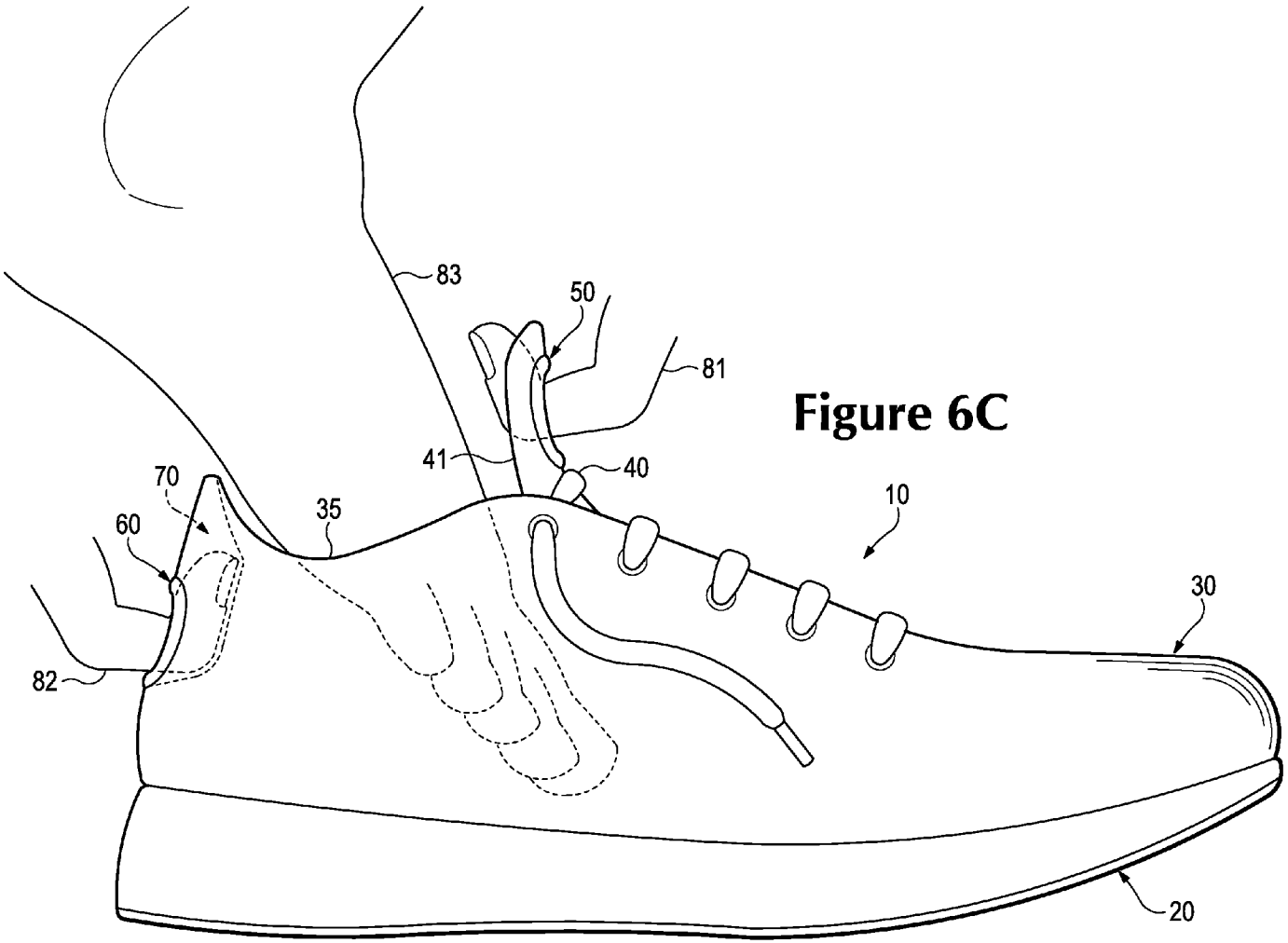

At this stage of the method, fingers 81 and 82 are respectively positioned through tongue opening 50 and heel opening 60. As depicted in FIG. 6B, the fingers are now separated to expand a size of ankle aperture 35. In effect, tongue 41 and the portion of covering element 31 in heel region 13 are pulled apart to increase the overall dimensions of ankle aperture 35. Referring to FIG. 6C, a foot 83 of the wearer is inserted into footwear 10 through the expanded ankle aperture 35. Once foot 83 is properly positioned, lace 40 may be tensioned and tied to secure foot 83 within footwear 10. As such, the presence of tongue opening 50 and heel opening 60 provide the wearer with greater ease when donning footwear 10. It should also be noted that a substantially similar reverse method may be utilized to remove foot 83 from footwear 10.

Further Configurations

Figure 7A:
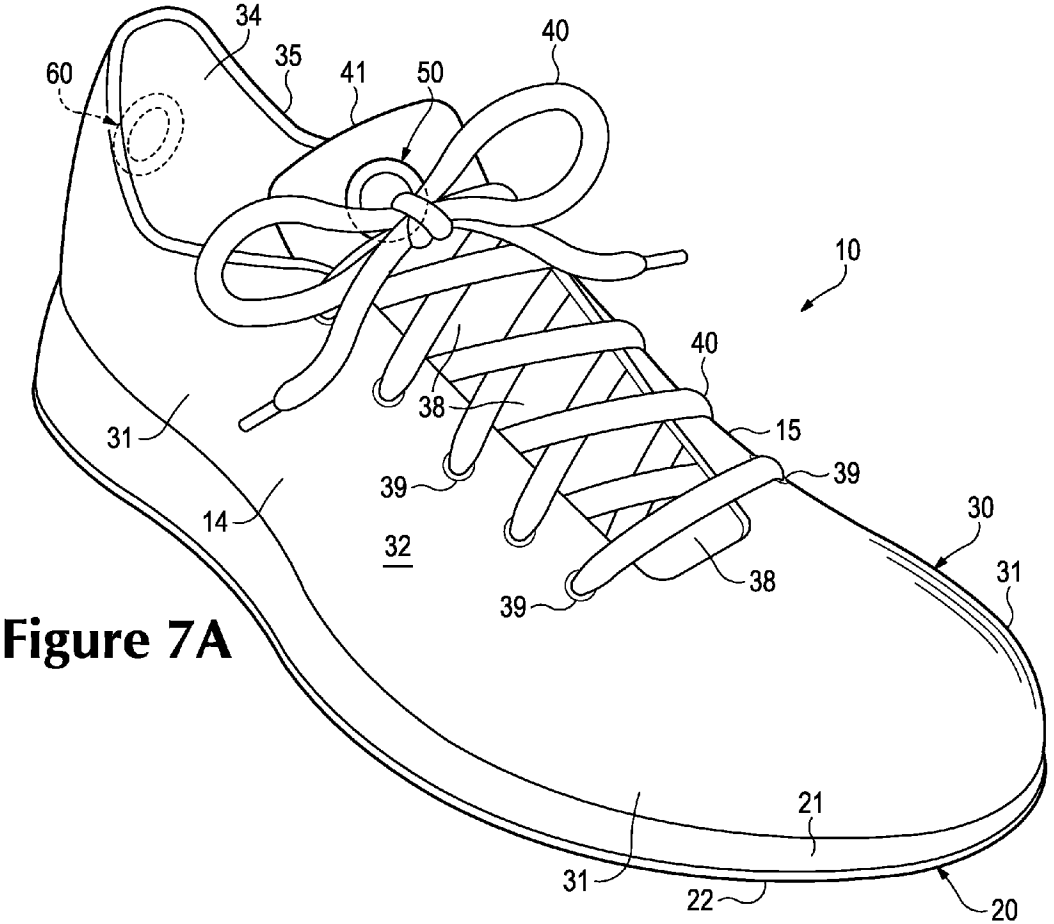
FIGS. 7A-7D are perspective views corresponding with FIG. 1 and depicting further configurations of the article of footwear.
Figure 7B:
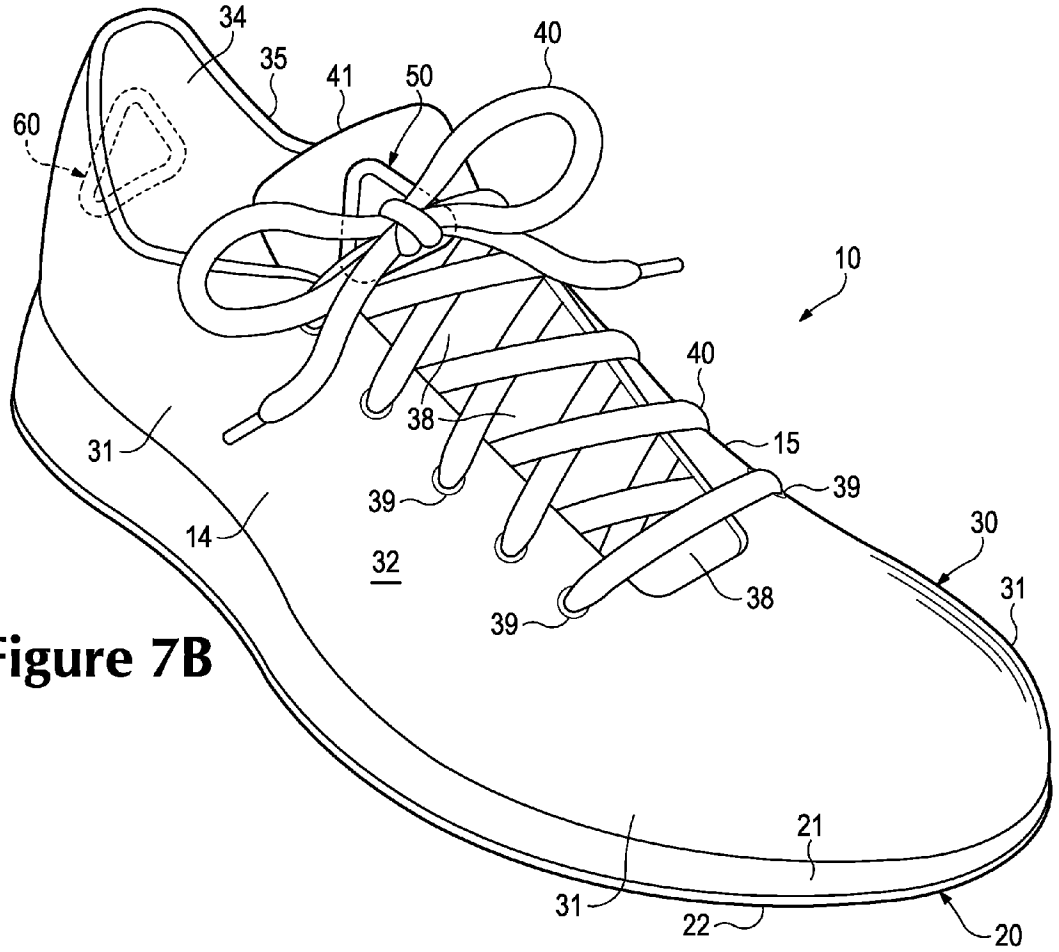
Figure 7C:
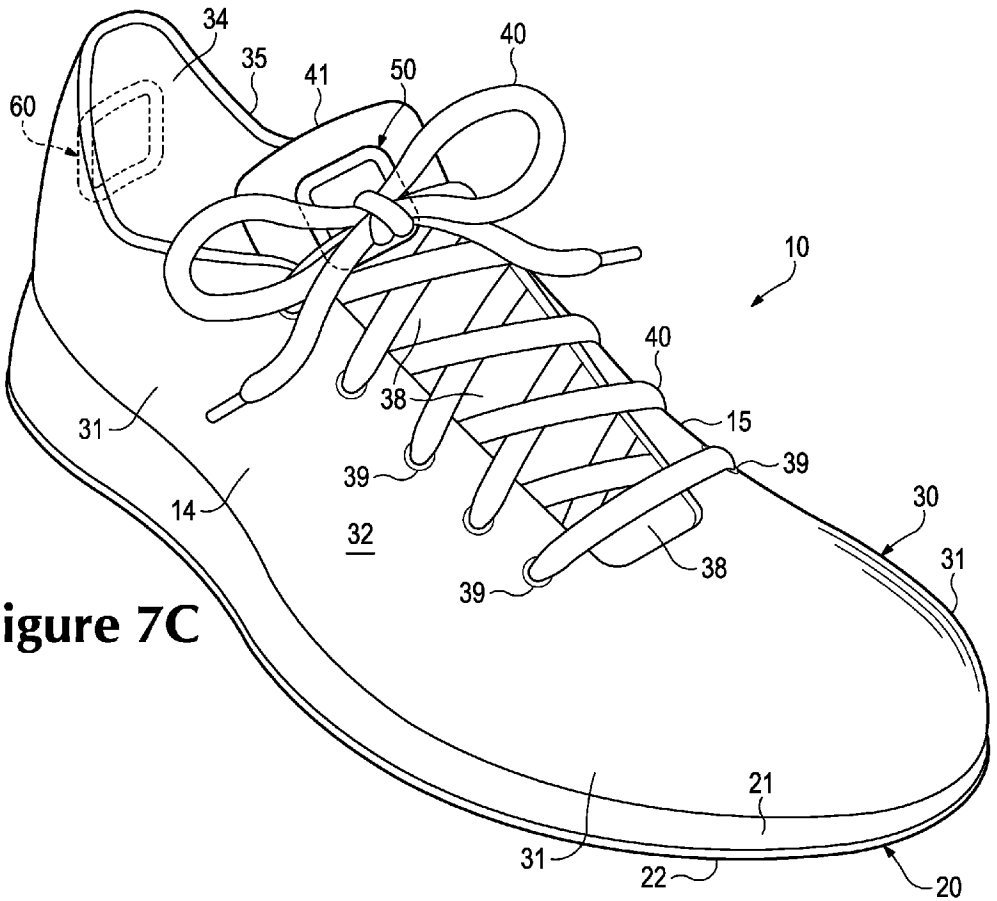
Figure 7D:
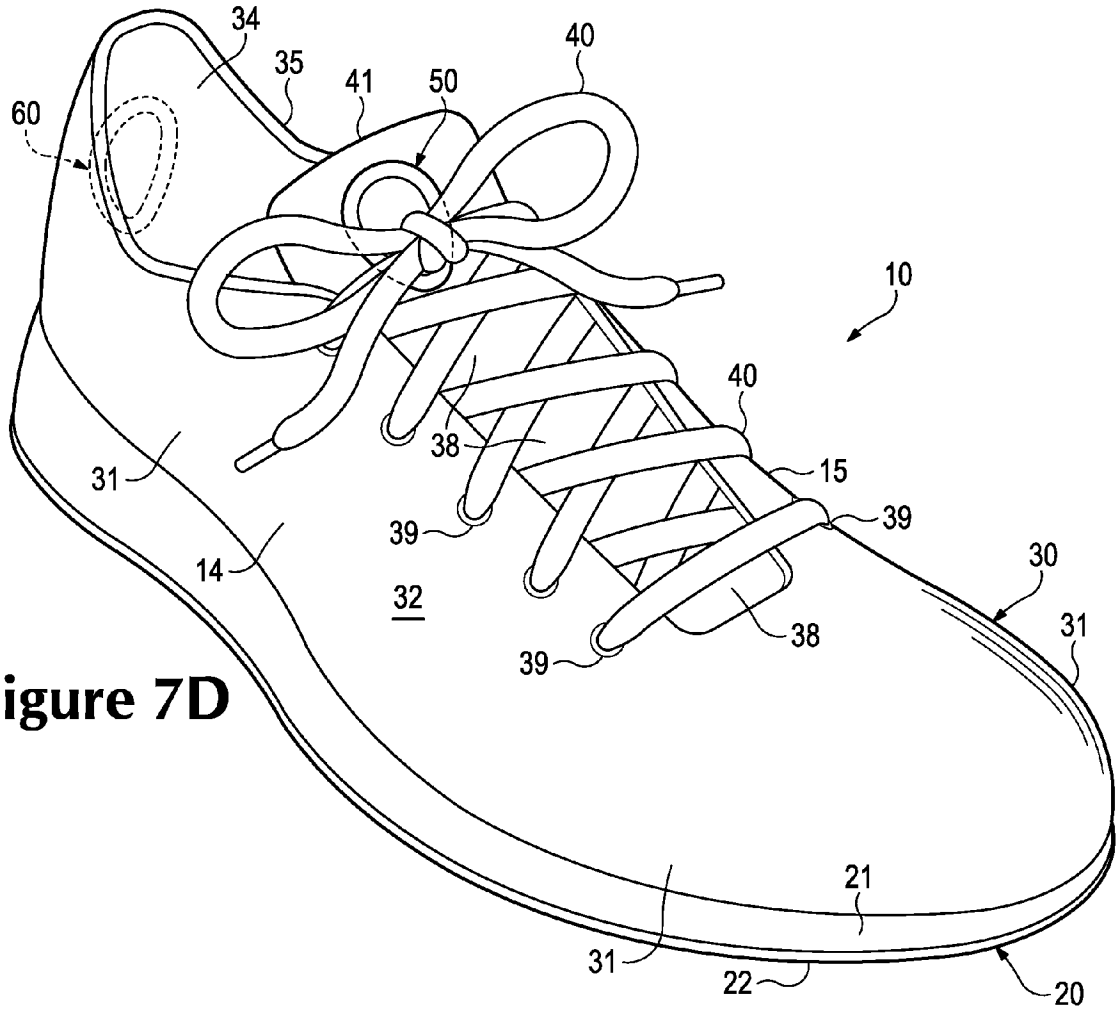

The configuration of footwear 10 described above is intended to provide one example of the many ways in which tongue opening 50 and heel opening 60 may be incorporated into footwear 10. Various examples of other configurations will be discussed below. Referring to FIG. 7A, for example, tongue opening 50 is depicted as having a smaller size. That is, a dimension extending across tongue opening 50 is reduced in comparison with other figures. Although the shape of tongue opening 50 may be circular, other shapes may be utilized. For example, FIGS. 7B, 7C, and 7D show tongue opening 50 as respectively having triangular, square, and teardrop shapes.

Figure 8A:
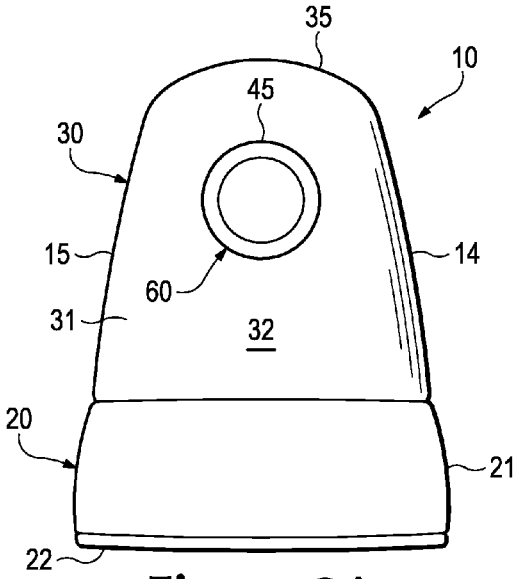
FIGS. 8A-8E are rear elevational views corresponding with FIG. 3 and depicting further configurations of the article of footwear.
Figure 8B:
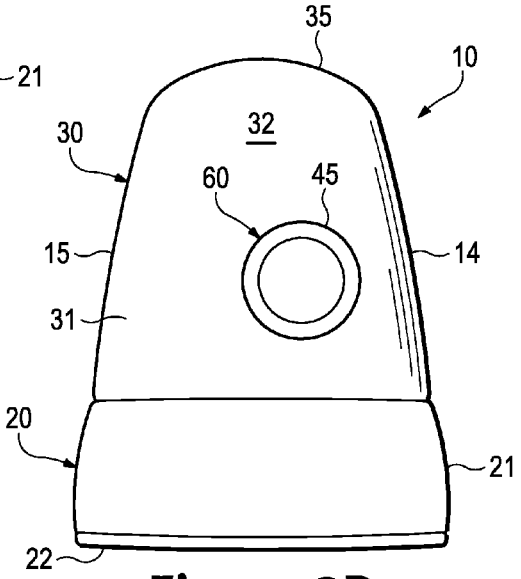
Figure 8C:
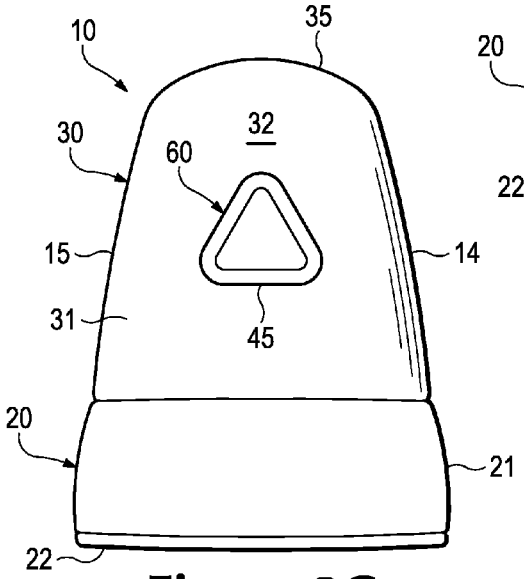
Figure 8D:
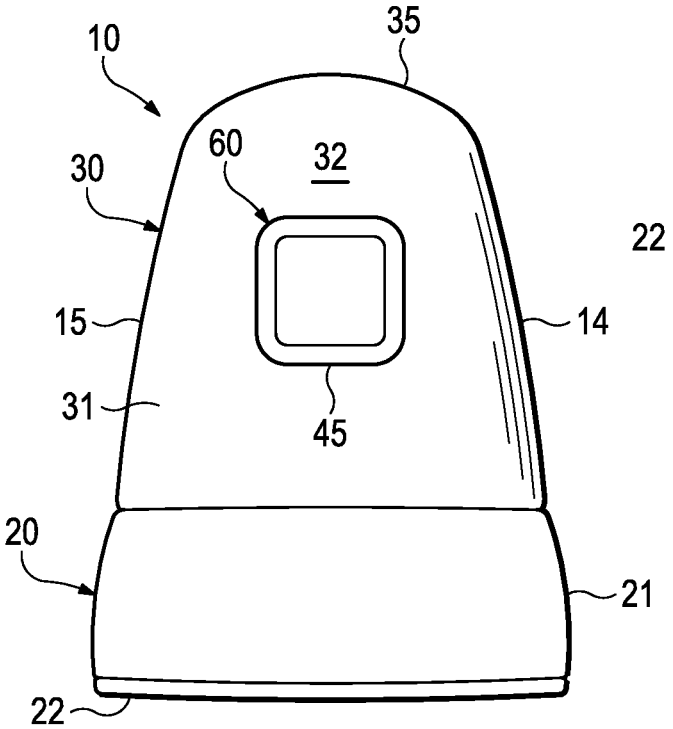
Figure 8E:
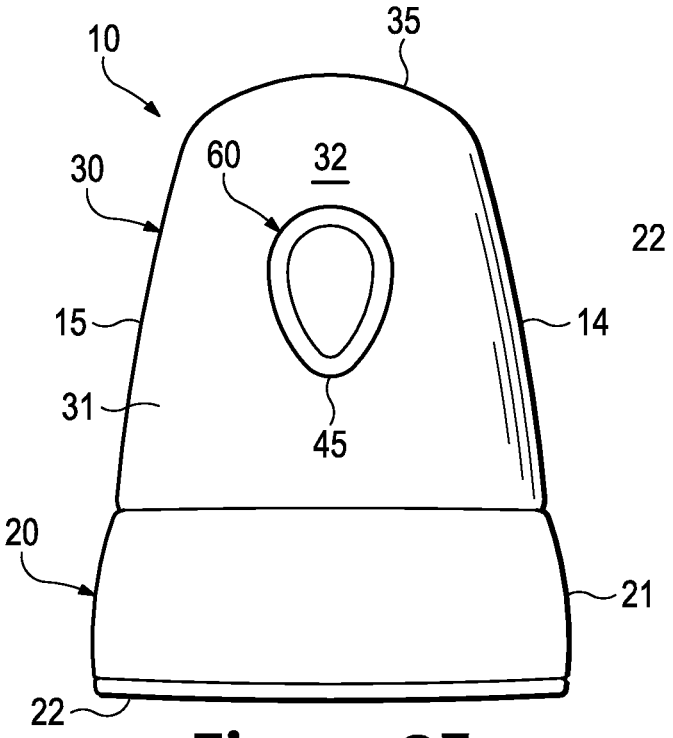

Features of heel opening 60 may also vary. As examples, heel opening 60 is located closer to ankle aperture 35 in FIG. 8A, and heel opening 60 is located further from ankle aperture 35 and offset from a centerline of footwear 10 in FIG. 8B. Although the position of heel opening 60 may vary significantly, FIGS. 8A and 8B depict configurations wherein heel opening 60 covers or corresponds with a midpoint of a distance between the upper edge of covering element 31 and an area where upper 30 is secured to sole structure 20. Although the shape of heel opening 60 may be circular, other shapes may be utilized. For example, FIGS. 8C, 8D, and 8E show heel opening 60 as respectively having triangular, square, and teardrop shapes. Although not depicted, heel opening 60 may also have a reduced size similar to FIG. 7A.

Figure 9B:
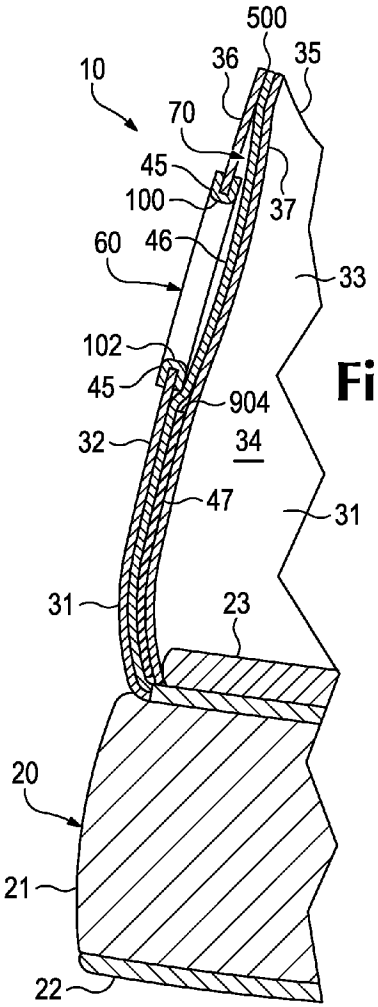
FIGS. 9A and 9B are cross-sectional views corresponding with FIG. 5 and depicting further configurations of the article of footwear.
Figure 9A:
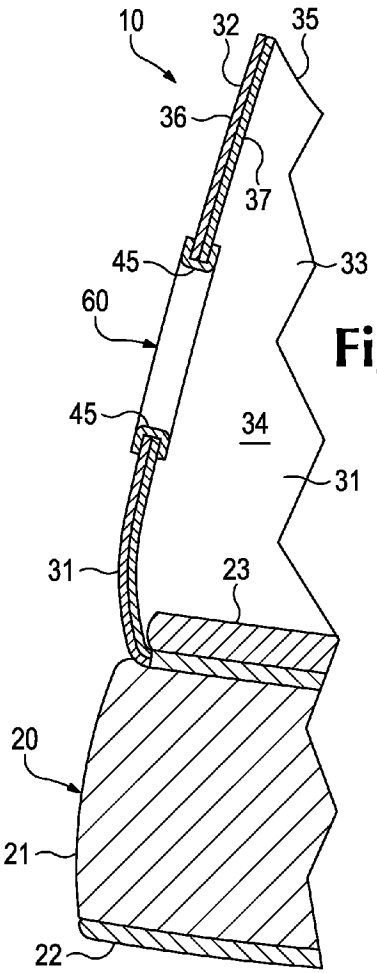

In other configurations, heel opening 60 may pass entirely through covering element 31, as depicted in FIG. 9A, and pocket 70 may be absent from footwear 10. As another configuration, heel opening 60 may be located to extend into upper 30 by passing through interior surface 33 and second layer 37. That is, rather than being on the exterior of footwear 10, therefore, heel opening 60 may be located and accessed by placing the finger or hand into void 34. Referring to FIG. 9B, various additional layers and material elements are present in covering element 31. More particularly, an intermediate layer 46 and a heel counter 47 are positioned between first layer 36 and second layer 37. Intermediate layer 46 may be formed from different materials than first layer 36 and second layer 37 to impart additional properties to upper 30 in heel region 13. As depicted, heel opening 60 does not pass through intermediate layer 46, thereby forming pocket 70 between first layer 36 and intermediate layer 46. Moreover, heel opening 60 is spaced upward from heel counter 47 to remove a potential obstruction and make locating a finger through heel opening 60 more comfortable for the wearer. In another configuration, heel opening 60 may pass through intermediate layer 46, thereby forming pocket 70 between intermediate layer 46 and second layer 37. Additionally, heel counter 47 is located in heel region 13 and between heel opening 60 and sole structure 20 to stabilize the heel area of the foot. Heel counter 47 may have a top edge 904.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the upper comprising:

a forefoot region and a heel region opposite the forefoot region;

an exterior surface and an opposite interior surface defining a void configured to receive a foot, wherein an upper edge of the exterior surface defines an ankle aperture in at least the heel region for providing the foot with access to void;

a tongue having a forward area and a rear area that is disposed between the forward area of the tongue and the heel region of the upper, the tongue having a tongue opening extending through the rearward area of the tongue and having a size sufficient to permit a finger of the wearer to pass into tongue opening; and wherein the heel region of the upper includes (a) a first layer that forms at least a portion of the exterior surface of the upper, (b) a heel opening extending through the first layer and having a size sufficient to permit a finger of the wearer to pass into heel opening, wherein the heel opening has a topmost point and a bottommost point, (c) a second layer located inward from the first layer and extending from the upper edge of the exterior surface to the sole structure, wherein the second layer is secured to the first layer along an area between the sole structure and the bottommost point of heel opening and wherein the second layer is designed to overlap the heel opening such that the second layer blocks access to the void via the opening, and (d) a third layer located inward from the second layer such that the second layer is sandwiched between the first layer and the third layer.

2. The article of footwear recited in claim 1, wherein at least one of the tongue opening and the heel opening has a circular shape.

3. The article of footwear recited in claim 1, wherein a dimension extending across the tongue opening is at least 1.5 centimeters, and a dimension extending across the heel opening is at least 1.5 centimeters.

4. The article of footwear recited in claim 3, wherein the topmost point of the heel opening is spaced from the upper edge, and wherein the first layer and the second layer are unsecured to each other in an area between the heel opening and the upper edge.

5. The article of footwear recited in claim 4, wherein a heel counter is located in the heel region in an area bounded between the heel opening and sole structure.

6. An article of footwear having an upper and a sole structure secured to the upper, the upper comprising:

a covering element having an exterior surface and an opposite interior surface, the interior surface defining a portion of a void within the upper for receiving a foot of a wearer, the covering element including a first layer forming at least a portion of the exterior surface and a second layer forming at least a portion of the interior surface, wherein (a) the covering element extends around the void in a heel region of the article of footwear between the sole structure and an upper edge of the covering element that defines an ankle aperture in at least the heel region for providing the foot with access to the void and (b) the second layer extends from the sole structure to the upper edge defining the ankle aperture;

a third layer disposed inward of the first layer such that the second layer is sandwiched between the first layer and the third layer;

a tongue located in the throat area and extending under the lace;

a tongue opening extending through a portion of the tongue located adjacent to the ankle aperture;

a heel opening extending through the exterior surface, the heel opening being disposed between the sole structure and the upper edge of the covering element, wherein the second layer is designed to overlap the heel opening such that the second layer blocks access to the void via the heel opening; and a pocket formed by the first layer and the second layer of the covering element within a space between the first layer and the second layer, the pocket being bounded by the bottommost point of the heel opening and the upper edge of the covering element, and the heel opening providing access to the pocket.

7. The article of footwear recited in claim 6, wherein at least one of the tongue opening and the heel opening has a circular shape.

8. The article of footwear recited in claim 6, wherein a dimension extending across the tongue opening is at least 1.5 centimeters, and a dimension extending across the heel opening is at least 1.5 centimeters.

9. The article of footwear recited in claim 6, wherein the tongue includes an interior element and an exterior sheath extending around a first surface and a second opposite surface of the interior element, the tongue opening extending through both the first surface and the second surface of the interior element and the exterior sheath.

10. The article of footwear recited in claim 9, wherein a flashing element is secured to both the first surface and the second surface of the exterior sheath, passes through the tongue opening, and extends around the tongue opening.

11. The article of footwear recited in claim 6, wherein the first layer is secured to the second layer in an area defined between the bottommost point of the heel opening and the sole structure.

12. The article of footwear recited in claim 11, wherein the heel opening extends through the first layer and not through the second layer.

13. The article of footwear recited in claim 6, wherein the heel opening is positioned at a midpoint of a distance between the upper edge of the covering element and an area where the upper is secured to the sole structure.

14. The article of footwear recited in claim 6, wherein a heel counter is located in the heel region in an area bounded between the heel opening and sole structure.

15. An article of footwear having an upper and a sole structure secured to the upper, the upper comprising:

a forefoot region and a heel region opposite the forefoot region;

an exterior surface and an opposite interior surface defining a void configured to receive a foot;

a tongue having a forward area and a rear area that is disposed between the forward area of the tongue and the heel region of the upper, the tongue having a tongue opening extending through the rearward area of the tongue and having a size sufficient to permit a finger of the wearer to pass into tongue opening; and wherein the heel region of the upper includes (a) an upper edge defining an ankle aperture in at least the heel region for providing the foot with access to the void (b) an exterior layer that forms at least a portion of an exterior surface of the upper, (c) a heel opening extending through the exterior layer and having a size sufficient to permit a finger of the wearer to pass into heel opening, (d) an intermediate layer located inward from the exterior layer, (e) an interior layer located inward from the intermediate layer such that the intermediate layer is sandwiched between the exterior layer and the interior layer, (f) a heel counter sandwiched between the interior layer and the intermediate layer, wherein the intermediate layer extends from the sole structure to the upper edge defining the ankle aperture and is designed to overlap the heel opening such that the intermediate layer blocks access to the void via the heel opening.

16. The article of footwear recited in claim 15, wherein the heel counter has a top edge disposed at a point level with or below a bottommost point of the heel opening.

17. The article of footwear recited in claim 16, wherein the exterior layer is secured to the intermediate layer in an area coinciding with the heel counter.

18. The article of footwear recited in claim 15, wherein the heel region of the upper has an upper edge defining an ankle aperture in at least the heel region for providing the foot with access to the void and the exterior layer is secured to the intermediate layer in an area defined between the upper edge of the upper and the sole structure.

* * * * *